US007272349B2

(12) United States Patent
Bessette

(10) Patent No.: US 7,272,349 B2
(45) Date of Patent: Sep. 18, 2007

(54) DOCTOR BLADE FOR TONER CARTRIDGE DEVELOPER ROLLER

(75) Inventor: Lionel C. Bessette, North Grafton, MA (US)

(73) Assignee: Clarity Imaging Technologies, Inc., Springfield, MA (US)

( * ) Notice: Subject to any disclaimer, the term of this patent is extended or adjusted under 35 U.S.C. 154(b) by 112 days.

(21) Appl. No.: 11/181,602

(22) Filed: Jul. 14, 2005

(65) Prior Publication Data

US 2007/0014594 A1 Jan. 18, 2007

(51) Int. Cl.
*G03G 15/08* (2006.01)

(52) U.S. Cl. ..... 399/284; 399/274

(58) Field of Classification Search ..... 399/284, 399/274; 118/261

See application file for complete search history.

(56) References Cited

U.S. PATENT DOCUMENTS 5,057,871 A * 10/1991 Hirose et al. ..... 399/284 X
5,552,867 A * 9/1996 Sekino et al. ..... 399/284
5,805,966 A * 9/1998 Yamada ..... 399/284
6,259,878 B1 * 7/2001 Sato et al. ..... 399/284
6,360,068 B1 * 3/2002 Kinoshita et al. ..... 399/284
2003/0108364 A1 * 6/2003 Do ..... 399/284

FOREIGN PATENT DOCUMENTS

JP 60-073659 A * 4/1985
JP 11-194609 A * 7/1999

* cited by examiner

*Primary Examiner*—Sophia S. Chen
(74) *Attorney, Agent, or Firm*—William A. Loginov; Hinckley, Allen & Snyder LLP

(57) ABSTRACT

A metering blade confronts the developer roller of a toner cartridge with a working face and associated upstream corner that is accurately controlled with respect to the developer roller to achieve a desired gap therebetween. More particularly, the quality of toner metering is determined through an appropriate technique and the angle of the bottom working face and working corner is varied using appropriate computer-controlled machining techniques to adjust the location of the corner with respect to the radial centerline of the roller at all points along the axial direction. In an illustrative embodiment, the blade's working face is formed to create a setback that is compound angle in two orthogonal directions. This compound angle reorients the upstream corner of the working face to compensate for irregular metering and electrostatic differences across the roller surface, particularly where toner is greater on one side of the roller than the other, opposing side.

5 Claims, 6 Drawing Sheets

DOCTOR BLADE FOR TONER CARTRIDGE DEVELOPER ROLLER

BACKGROUND OF THE INVENTION

1. Field of the Invention

This invention relates to toner cartridges for electronic printers and more particularly to metering or "doctor" blades for regulating the feed of toner to image elements from a feed or developer roller.

2. Background Information

Electronic or "laser" printers use a focused light beam to expose discrete portions of an image transfer drum so that these portions attract printing toner. Toner is a mixture of pigment (typically carbon black or a non-black color component) and a plastic component, which is typically polystyrene or polyester. The toner becomes electric statically attracted to exposed portions of the image transferred drum. As a transfer medium such as paper is passed over the rotating image transferred drum, some of the toner is laid onto the medium. Subsequently, the medium passes through a heated fuser so that the toner's plastic component is melted into permanent engagement with the underlying medium.

The vast majority of desktop laser printers currently available utilize replaceable toner cartridges that incorporate an image transfer drum, a toner tank and a metering system and a drive mechanism for the drum and metering system. An exemplary toner cartridge toner tank assembly 100 according to the prior art is shown in FIG. 1. As described above, the toner cartridge of this example can be adapted to install in the E320/E322™ series printer, available from Lexmark®, and operating in a compatible print engine. Note that, while a particular Lexmark cartridge is shown herein, this description is meant to apply to a wide variety of cartridges by this manufacturer and others, all of which employ similar principles for feeding and metering toner. The cartridge includes a toner tank housing 102 that defines generally a cylindrical shape. Within the tank, along the bottom is located a toner supply 104 consisting of an electrostatically attracted particulate compound. In this example, the toner is a "one-part" toner having a color (carbon black, for example) infused with a melting substance, such as polystyrene plastic. Toner is deposited by a feed or metering section 106, having a foam-surfaced supply roller 110, elastomeric (urethane) feed or "developer" roller 112 and metering blade 114, onto an electrostatically charged image transfer drum 116. The drum 116 is charged in a particular pattern that corresponds to the pattern laid down by a coherent light source (e.g. a laser) L. The patterned toner is transferred from the drum 116 to a print media (paper for example) as it passes by the drum in synchronization with its rotation. The drum and other components of the cartridge are generally part of an overall outer cartridge housing that includes the tank assembly 100 and feed section 106 as well as certain sensors and control electronics.

The toner is continuously agitated and urged from the "sump" of the tank bottom to the feed section 106 by rotation (curved arrow 118) of an agitator paddle 120. The paddle 120 is formed as a framework with a leading edge supported on a series of ribs that are, in turn, connected to a central axle 124. The central axle 124 is rotationally supported at the center of the tank cylinder. During paddle rotation, the paddle sweeps through an arc that passes just above the inner surface of the tank, while the ribs cut through the toner, enabling the toner to pass through interstices defined therebetween. In this manner, the leading edge serves to break up and drive the toner upwardly into the feed section 106 though slots 130 in the tank.

The feed section rollers and agitator paddle are driven by a printer engine drive motor (not shown) that engages an external gear train (not shown). This gear train interconnects and drives the paddle 120, the foam-covered supply or "adder" roller 110, urethane-surfaced metering or developer roller 112 and image drum 116 in rotational synchronization about respective axes of rotation 124, 140, 142 and 146.

The developer roller 112 is particularly adapted to carefully meter the amount of toner delivered to the exposed (attractive) parts of the image drum 116. To ensure that excess particles do not adhere to the developer roller 112 before it releases the toner at the release point 152 (a point of closest proximity between developer roller 112 and image drum 116), the metering blade 114 is carefully positioned above the developer roller's (112) surface. The blade is spring-loaded to exert a downward force (arrow DF) of approximately 16 ounces (in this example) against the elastomeric surface of the developer roller. Controlling spring pressure on the blade is an important factor in properly metering toner using this blade style. A lighter spring allows more toner to pass through, and vice versa. Similarly, the location of upstream corner 170 of the blade's working face and the surface of the roller 112 is set precisely and aligned with respect to the axis 142 (and associated radial centerline 172) to achieve an even metering of toner across the axial length of the roller 112. In operation, the corner 170 serves to block the majority of toner particles picked up by attraction to the roller surface. A relatively thin film of particles manages to pass between the impingement point between the blade corner 170 and the roller surface. This film is selectively released to the image drum for subsequent transfer to the printable substrate. Any remaining excess toner after release to the image drum passes by semi-rigid plastic (typically Mylar) strip 160 that acts as a barrier between the bottom of the toner sump and the developer roller 112. Downstream of the barrier strip 160, new toner from the sump is attracted onto the developer roller 112 to combine with the preexisting toner that remains after release to the drum. This new film presents itself to the blade 114 for metering. Note that a small amount of toner may also fall from the roller 116 and/or drum 116 outside of the feed section 106. This errant toner is collected in a waste area (not shown) that is beneath the feed section 106 in an adjacent section of the outer tank housing (also not shown).

To provide a more-even release of toner from the developer roller 112 to the image drum 116 (and thereby reduce toner waste and increase overall print quality), it is desirable to improve the metering of toner before it is presented to the image drum. The metering blade 114 is, essentially, the last opportunity to properly regulate toner supply before release to the image drum. It is, thus, desirable to improve metering blade performance to the greatest extend practicable. The uneven release of toner across the image drum leads to irregular print quality. However, it is not uncommon for a newly manufactured toner cartridge to exhibit significant variation in toner metering between each of opposing ends of the developer roller 112. Often the variation results from slight misalignment of the roller's axis/centerline with respect to the working face of the blade 114 and its upstream corner. Even a one-thousandth-of-an-inch misalignment may significantly affect print quality. In addition, irregular toner metering across the roller can result from electrostatic differences across the roller or blade's surface. Both the roller and blade are charged by AC and DC current to cause toner to be attracted to the roller. The urethane roller may exhibit dielectrically created differential across it length. This electrostatic differential may cause uneven metering even where the blade and roller are perfectly aligned. Finally, even where a cartridge is finely tuned to provide metering evenly across its length, the metering may become variable simply by employing a different type or batch of toner with slightly different granularity and/or electrostatic properties. A technique for quickly, predictable and efficiently dealing with all these causes of metering variability is highly desirable.

SUMMARY OF THE INVENTION

This invention overcomes the disadvantages of the prior art by providing a metering blade that confronts the developer roller of a toner cartridge with a working face and associated upstream corner that is accurately controlled with respect to the developer roller to achieve a desired gap therebetween. More particularly, the quality of toner metering is determined through an appropriate technique (such as analysis of print quality) and the angle of the bottom working face and working corner is varied using appropriate computer-controlled machining (or other metal-forming) techniques to adjust the location of the corner with respect to the radial centerline of the roller at all points along the axial direction. In an illustrative embodiment, the blade's working face is formed to create a setback that is compound angle in two orthogonal directions (with respect the lengthwise direction, parallel to the roller axis). This compound angle reorients the upstream corner of the working face to compensate for irregular metering and electrostatic differences across the roller surface (in the axial direction), particularly where toner is greater on one side of the roller than the other, opposing side. In production, a standard setback profile can be used for further cartridges in the production run.

In further embodiments, where toner metering is uneven in, for example, the axial center region relative to the ends of the roller, the blade's working face and upstream corner can be defined by two or more oppositely oriented compound angles that meet in the center or proximate thereto. Other compound cuts with a plurality of facets to compensate for complex irregularity across the roller surface can be implemented in alternate embodiments.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
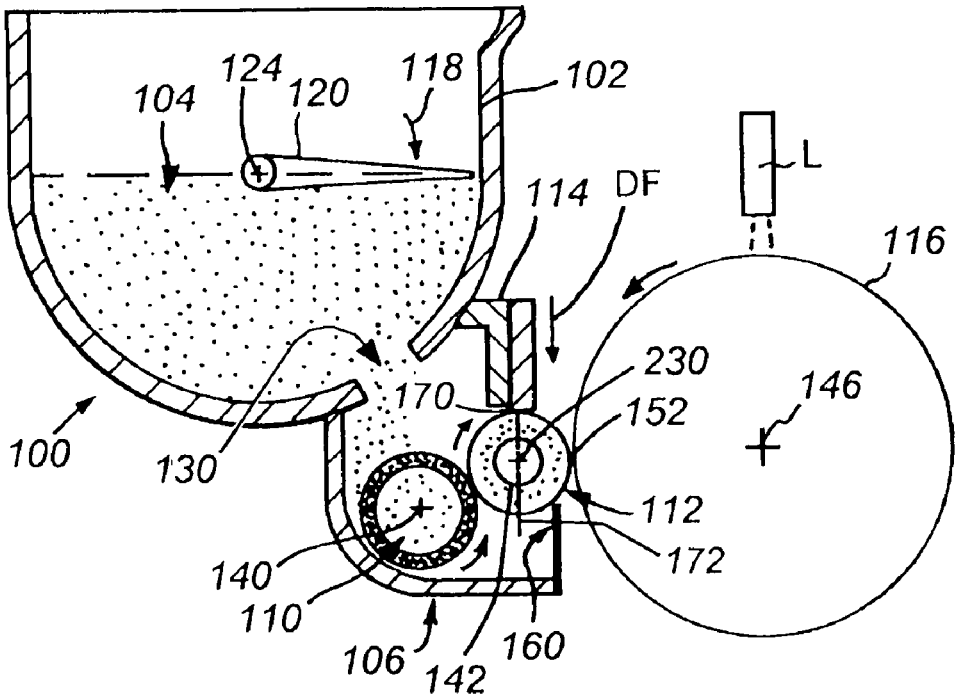
FIG. 1 (PRIOR ART)
FIG. 1, already described, is a side cross section of an exemplary toner cartridge including toner tank developer roller assembly and metering blade in communication with an image transfer drum according to the prior art.
Figure 2:
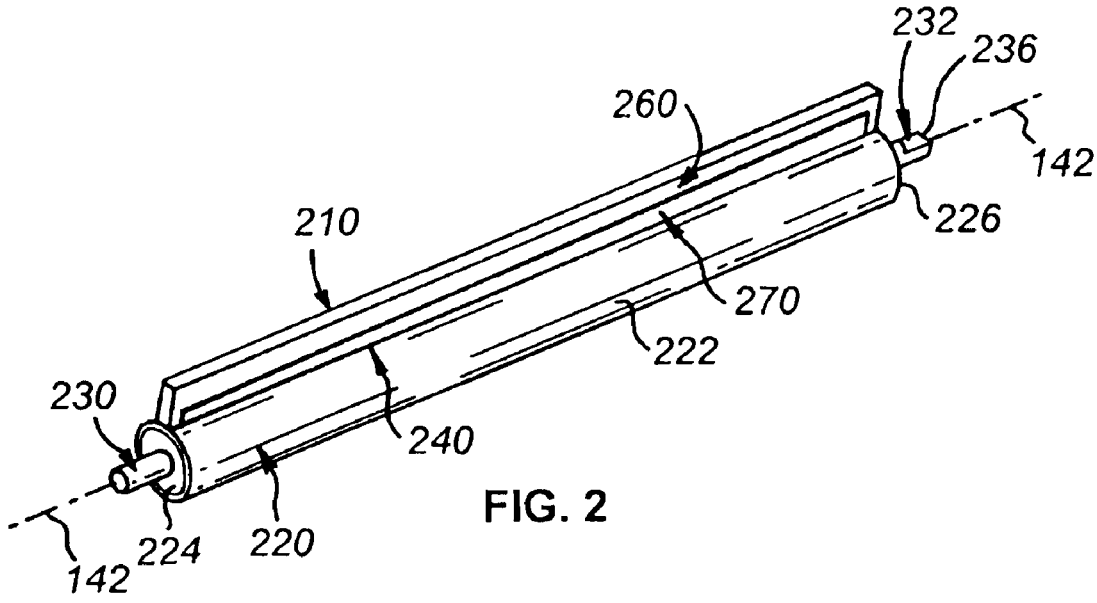
FIG. 2 is an isometric view of a typical developer roller, and the metering blade according to an embodiment of this invention.
Figure 3:
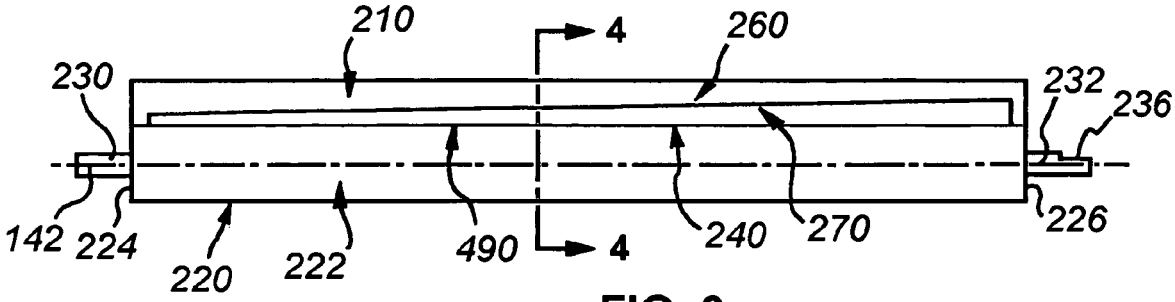
FIG. 3 is a front view of the developer roller and metering blade of FIG. 2.

A metering blade 210 and developer roller 220 according to an embodiment of this invention are shown in FIGS. 2 and 3. For purposes of illustration, the blade 210 and roller 220 are shown apart from the surrounding toner cartridge and associated components (e.g. the housing, toner tank, paddle assembly, supply roller, and image drum). These components may be similar to those shown and described for FIG. 1 above, or may be part of a differing system, so long as the blade and developer roller operate to deliver a metered feed of toner to the image drum, as described generally herein.

Figure 4:
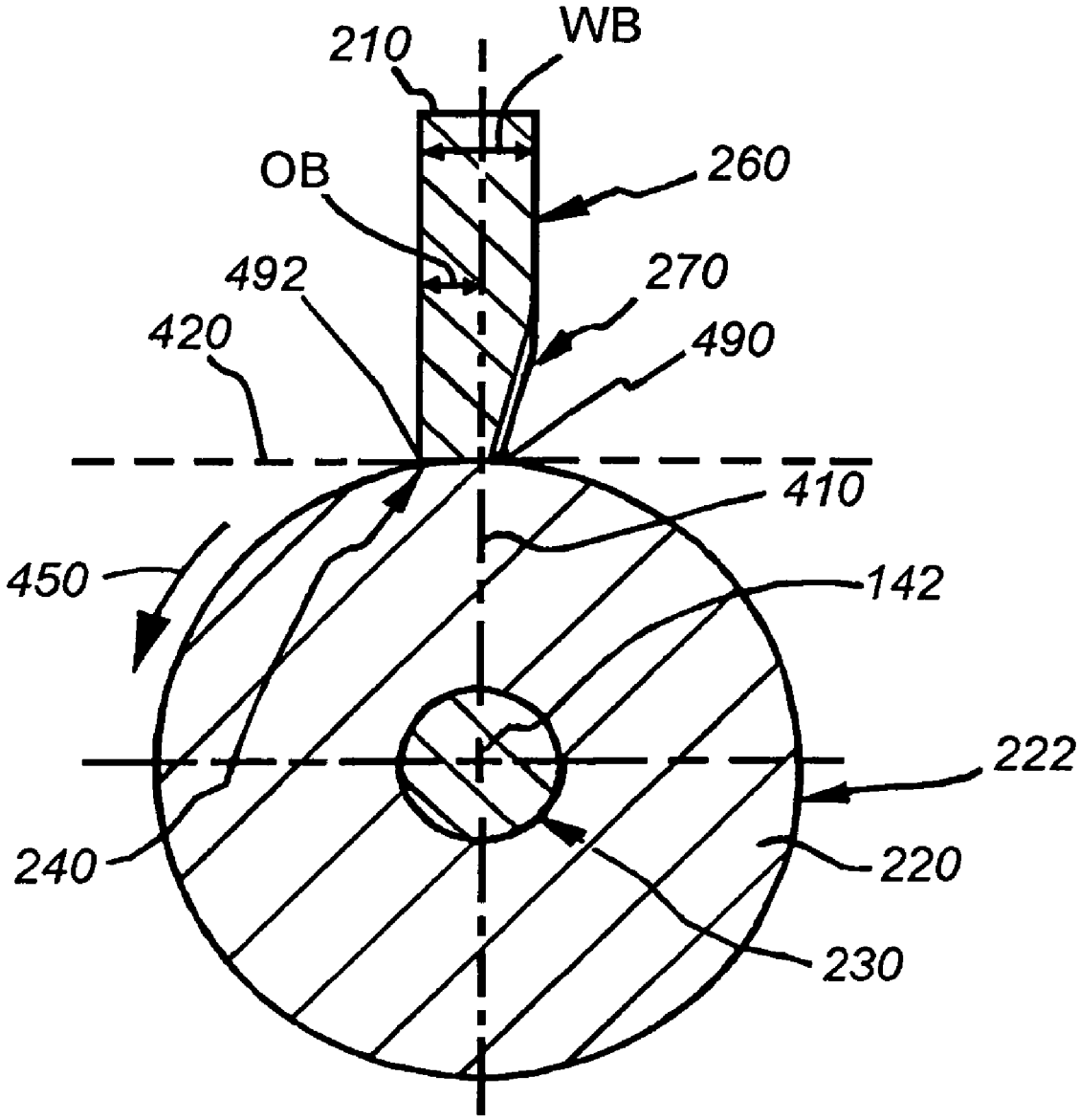
FIG. 4 is a side cross section of the developer roller and metering blade taken along line 4-4 of FIG. 3.

The exemplary developer roller 220 defines a straight-cylindrical surface 222 extending axially (along axis 142) between a pair of opposing ends 224 and 226. The roller is supported on metal (steel) shaft ends 230 and 232 that can be keyed (key 236) to rotationally secure a gear (not shown) or other drive member. As discussed above, the roller surface 222 is located in pressurable contact with a bottom (horizontal) working face 240 of the metering blade 210 of this embodiment. With further reference to the cross section of FIG. 4, the upstream corner 490 and opposing downstream corner 492 blade's (210) working bottom face 240 are each located in a particular alignment with respect to the vertical centerline 410 of the roller 220. This centerline 410 is defined along a plane passing through the axis 142 of rotation of the roller and generally perpendicular to a plane (along dashed line 420) defined by the blade's bottom working face 240. In FIG. 4 the roller rotates counterclockwise as shown by the arrow 450. This is, thus, defined as the "upstream-to-downstream" direction in terms of toner pickup from the tank and delivery to the image drum and the relative positioning of blade faces.

In this embodiment the upstream corner 490 of the bottom working face 240 is set back in an upstream direction from the vertical centerline 410 as shown. Since this corner traverses the axial length of the roller at an angle, the setback varies as a function of axial position. Nevertheless, the corner 490 is effectively set back to some degree from the centerline 410 across its entire length in this example. In other examples, a portion of the corner 490 may reside on or very near the centerline 410.

Figure 4A:
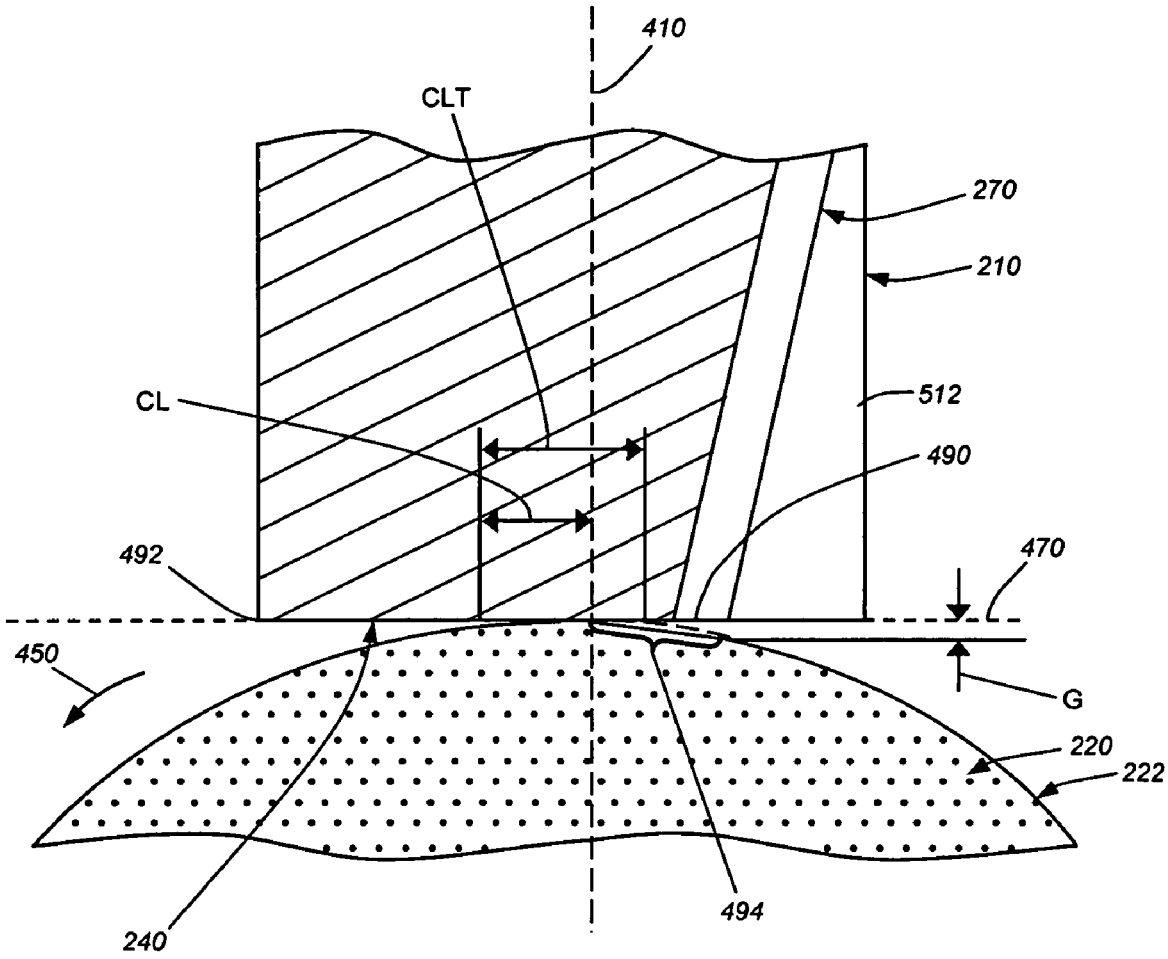
FIG. 4A is a fragmentary side cross section of the developer roller and metering blade of FIG. 4 showing the effect of downward blade pressure on the roller surface in further detail.

FIG. 4A represents the observed response by the surface 222 of the exemplary developer roller 220 to the pressurable engagement of the bottom working face 240 of the blade 210. The theoretical contact area is represented by the width CLT that effectively straddles centerline 410. However, analysis of the wear pattern on the face 240 reveals that effective contact is made mainly on the downstream side of the centerline along the reduced width CL. It is surmised that a (out-of-round) deformed space 494, characterized by a vertical gap G between the plane (dashed line 470) of the working face 240 and the beginning of the out-of-round, is generated on the roller surface upstream of the center line 410. While the mechanism for creating the out-of-round may involve several physical factors, one factor is believed to be the elongation of the roller surface 222 during motion. The size and shape of the gap G, in part, regulates the amount of toner that is allowed to slide between the surface and working face 240, where they contact. The size and shape of the lead-in to the gap is, likewise, provided by the position of the upstream corner 490. Thus, the amount of setback controls the gap G between the roller surface 222 and the working face 240 of the blade 210. Since the roller 220 is cylindrical, relocating the upstream corner 490 forwardly or rearwardly along the plane 470 with respect to the centerline 410 sets the precise character of the gap G between the roller surface 222 and the working face 240.

Assuming that the unevenness in metering is relatively linear from one end of the roller to the other (either based upon horizontal and/or vertical blade-to-roller misalignment or dielectric effects), setback 270 shown herein is appropriate. That is, a compound angle is defined in the blade's upstream vertical face 260 that is more-pronounced on one end than the other. Typically the more-pronounced end is the end requiring additional toner. By way of example, FIGS. 5, 6 and 7 define the characteristics for a compound angle setback 270 for the blade 210 so as to correct a relatively linear variation in toner metering across the axial length of the roller. At the right side 510 of the blade 210, the setback defines a vertical height H1, while at the left side 520, the setback has a vertical height H2, whereby H1>H2. Note that a small flat (non-setback step) region 512, 522 exists at each end, between the corresponding edge 526, 528 of the setback 270 and the corresponding end 514, 524 of the blade 210. This is a non-printed area on the image drum, and thus, does not require a setback. In alternate embodiments it is expressly contemplated that the steps 512 and 522 can be omitted and a full-length compound-angle setback can be provided across the complete axial length of the blade. In the exemplary embodiment, the Length LE (FIG. 6) is approximately 0.140 inch. Other dimensions for this region 512, 522 (or the omission of this region) in alternate embodiments are expressly contemplated.

Figure 5:
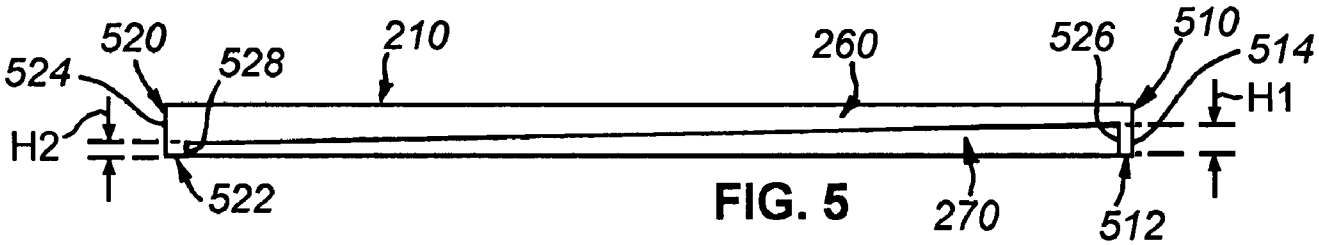
FIG. 5 is a front view of the metering blade of FIG. 2.
Figure 6:
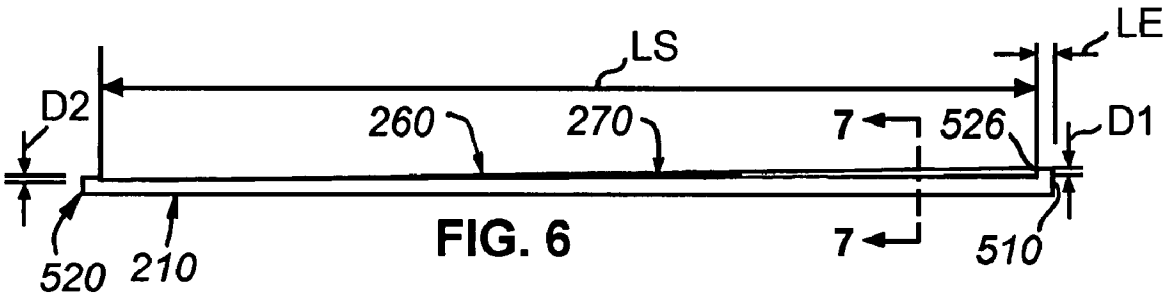
FIG. 6 is a bottom view of the metering blade of FIG. 2.
Figure 7:
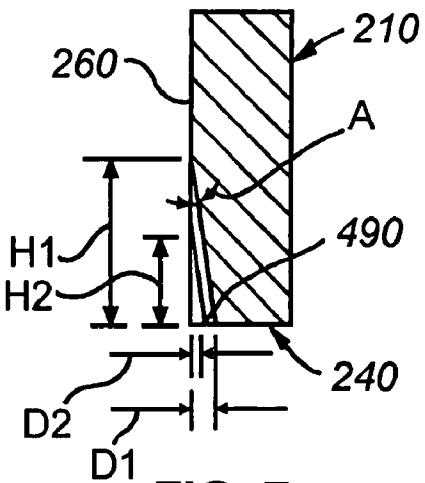
FIG. 7 is a side cross section of the metering blade taken along line 7-7 of FIG. 6.

As shown collectively in FIGS. 5-7, the compound angle of the setback defines a horizontal depth D1 and D2 at each blade end 510, 520 that corresponds to the respective vertical height H1 and H2. In this example, D1>D2. Like the vertical height, the depth varies linearly across the length between D1 and D2. The relationship of H1 and H2 to D1 and D2 is a function of the setback angle A (FIG. 7) with respect to the vertical plane of the upstream blade face 260. The larger the value A, the greater the relative depth of D1 and D2 for a given height H1 and H2. In this embodiment A is between approximately 3 and 5 degrees. Other values for the acute angle A are expressly contemplated.

In this example, the following exemplary dimensions are employed to correct a typical linear (approximately) variability of toner metering across a roller with a blade 210 having a maximum print region (setback axial length LS of approximately 8.804 inches): H1≈0.272 inch; H2≈0.038 inch; D1≈0.038 inch; D2≈0.019 inch. Referencing FIG. 4, also, the overall width WB of the blade 210 is approximately 0.157 inch in this example, and the downstream face projects a distance OB of approximately 0.79 inch from the centerline 410. Of course all of these measurements are highly variable, and will typically differ for a particular type and/or production run of toner cartridges. In addition, these measurements are adapted particularly for a roller and blade combination exhibiting a relatively linear variation in toner between opposing ends. In some instances, the variation is non linear. For example, the toner density may be greater near the center than the ends, or vice versa. In such instances, the blade may define a setback with a plurality of compound angles that place the working face's upstream corner at a given gap distance with respect to the roller at various points along the roller's length. Such a plurality of compound angles may be expressed as a substantially continuous curve or a helix (possibly formed from small linear segments) where appropriate. All such setback shapes can be produced with relative ease employing modem computer-controlled machining techniques, operating on a blade in which the working face (prior to machining) is appropriately registered with respect to the machine's cutting components. This ensures a predictable and repeatable result.

Figure 8:
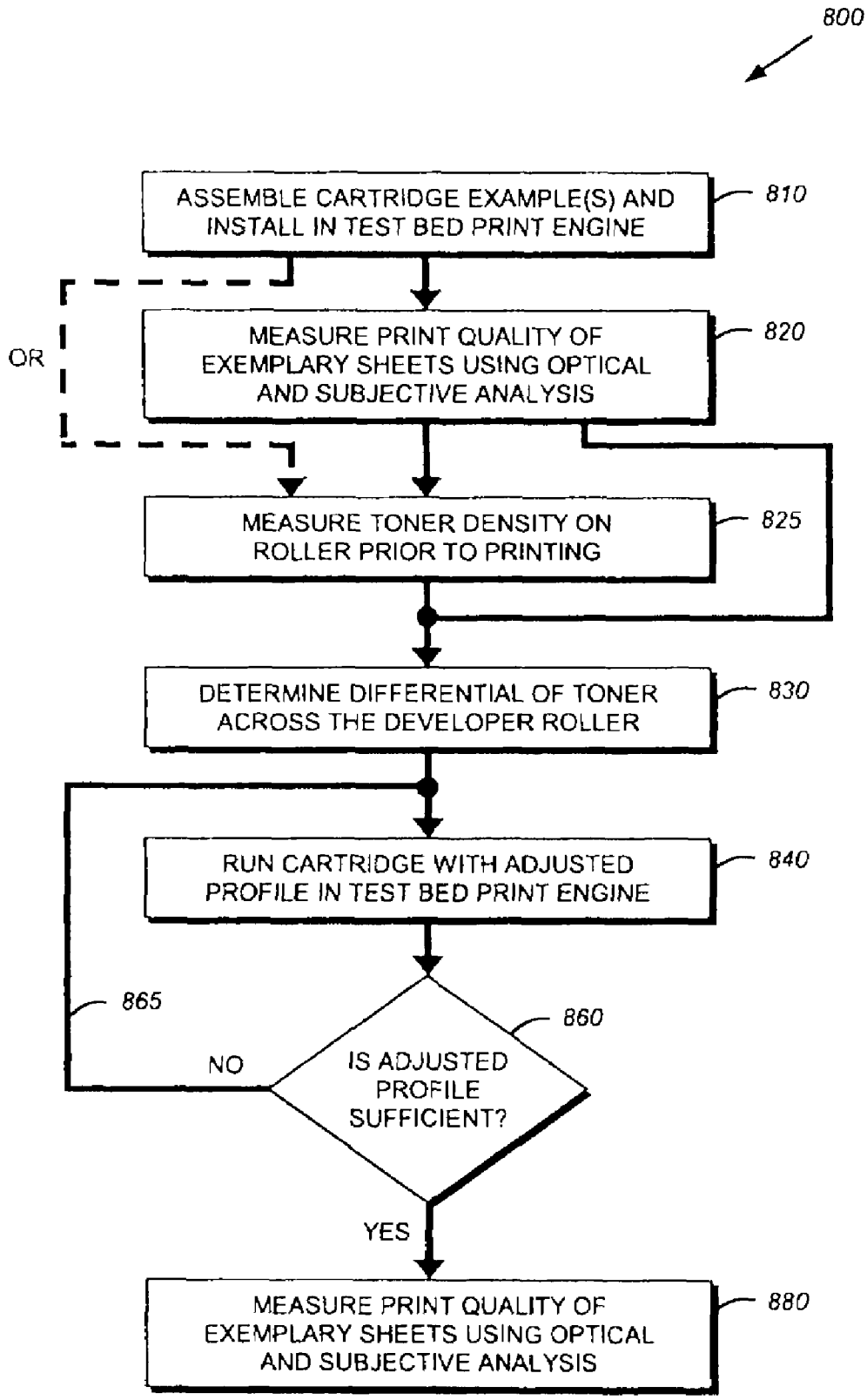
FIG. 8 is a flow diagram of a method for adjusting toner metering through control of the working face of the metering blade.

The determination of an appropriate setback profile can be achieved in a number of ways. FIG. 8 depicts a method 800 for determining an appropriate setback profile according to an illustrative embodiment. In general the results of feeding toner through one or more exemplary cartridges from a given production run and/or toner batch are analyzed for variability of metering across the length of the roller. More particularly, in accordance with step 810, one or more toner cartridges are assembled with the standard blade, roller and toner elements to be used in a production run. While the techniques of this invention can be applied on an individual basis to each cartridge being manufactured, in general, a given production run of cartridges will most likely exhibit similar toner metering characteristics, and thus, adjustments for the entire production run can be made based on a few samples at the outset. These test cartridges are installed in one or more test beds (e.g. print engines) and they are run using a standard test pattern that may include predetermined print profiles, gradients, etc.

The results of the tests (step 810) are output as printed sheets that are analyzed according to step 820. The analysis can be a subjective judgment of an operator as to print evenness and/or overall quality across the width of the printed sheet, or it can be is based upon an optical (contrast and/or brightness-based) electro-optical scan of the sheet for strong and weak toner regions.

Alternatively, analysis of the metering quality can be based upon a direct determination of the level of toner laid upon the roller across its surface (step 825) as it is being delivered to the image drum (downstream of the blade). A variety of analyses can be used to determine toner level across the roller surface including, but not limited to, a physical measurement of toner layer thickness, optical analysis or electromagnetic and/or electrostatic analysis.

Based upon the analyzed variation in toner distribution across the length of the roller, the relative differential versus roller position (length) is computed (step 830). The derived differential is then used to determine the blades setback profile. The profile may not map one-to-one with the analyzed differential, but may, instead, comport to a formula that is linear or non-linear. Such a formula or metric for setbacks adjustment may be computed through trail and error techniques after analyzing a large number of cartridges, adjusting setback profiles of their blades and measuring the results. In any event, the profile of the blade for the exemplary cartridge is adjusted according to the predetermined formula or metric in step 830. The cartridge is then run in the print engine again (step 840). The results of the run are analyzed (see steps 820 and/or 825), and these results are gauged for acceptability. In other words, using objective or subjective criteria, the operator determines whether the adjusted profile yields the desired print quality/metering (decision step 860). If the results are unacceptable, then the procedure repeats steps 840 and 860 (via branch 865) until the results are deemed sufficient. Additional adjustments to the profile may be in accordance with a predetermined, incremental adjustment approach, in which the setback is gradually changed and the results are tested. Results that lead further away from the desired result are noted as undesirable, while results that lead toward the desired result are retained, and the profile in incremented further in this direction. When the desired result is attained, the profile parameters are stored and that standard profile is employed for further cartridges in the production run (step 880). While this procedure is used to determine the profile for an entire production run (or even an entire cartridge type) it is possible to employ it on an individual cartridge basis (i.e. each cartridge being produced is individually tuned for optimum blade metering). Alternatively, the adjustment according to this procedure can be performed on a timed basis (e.g. every week), to ensure quality.

The above-procedure 800 employs both trial and error and formulaic techniques to achieve the desired result. It is expressly contemplated that a variety of procedures can be employed to derive acceptable blade-setback profile-adjustment criteria and parameters for a given toner differential across the length of the roller. In alternate embodiments, a look-up table can be derived from experimental results, varying the gap between the blade and the roller. Clearly, a variety of techniques can be employed. In general, a trial and error approach, slowly incrementing the setback profile until desired results are achieved can be used as a fallback where formulaic and other numerically derived approaches are insufficient.

The foregoing has been a detailed description of an illustrative embodiment of this invention. Various modifications and additions can be made without departing from the spirit and scope thereof. For example, the cartridge illustrated herein and its operational components are only one of many configurations that are contemplated in accordance with this invention. In alternate embodiments, toner tank shapes and agitators may vary, and certain moving/stationary components (adder rollers, squeegees, etc.) may or may not be present. Additionally, while a metering blade setback defining a "compound angle" is shown and described the setback can be another shape, such as a trough with a parallel (e.g. angle A=0 degrees) face respecting the surrounding, non-setback down-stream face of the metering blade. In this case, location of the upstream corner to define the desired characteristics of the gap G relative to the roller surface is of greatest significance. Accordingly, this description is meant to be taken only by way of example, and not to otherwise limit the scope of this invention.

What is claimed is:

1. A metering blade for a toner cartridge having a developer roller with an axis of rotation extending in an axial direction comprising:

an upstream face relative to an upstream-to-downstream direction of developer roller rotation; and a setback formed in the upstream face along a predetermined portion of the upstream face in the axial direction, the setback defining an upstream corner at each point along the axial direction that is positioned with respect to a centerline taken through the axis so as to provide a predetermined gap characteristic between the roller surface and the corner at each point along the axial direction, whereby metering of toner by the gap is controlled;

wherein the setback comprises a compound angle that varies from a first end of the blade to an opposing second end of the blade in each of two orthogonal directions with respect to the axial direction.

2. The metering blade as set forth in claim 1 wherein the setback is constructed according to a process, comprising the steps of:

a) analyzing a level of toner across the roller in the axial direction delivered to an image drum;

b) computing a profile of the setback in response to the analyzing step; and c) forming the setback on the blade in accordance with the computed profile.

3. The process as set forth in claim 2 further comprising the step of:

d) providing the blade, subsequent to step (c) to the toner cartridge and analyzing a level of toner across the roller in the axial direction delivered to the image drum, and thereafter adjusting the setback on the blade according to a predetermined rule if the level of toner across the roller is unacceptable.

4. The process as set forth in claim 3 further comprising (e) repeating step (d) until the level of toner across the roller is acceptable.

5. The process as set forth in claim 4 further comprising storing an adjusted profile derived from step (e) and forming a standard setback in a blade of a further cartridge in accordance with the stored adjusted profile.

* * * * *